US005479436A

United States Patent [19]

Hashida et al.

[11] Patent Number: 5,479,436

[45] Date of Patent: Dec. 26, 1995

[54] METHOD OF HEATING AND MELTING METAL AND APPARATUS FOR MELTING METAL

[75] Inventors: Hideo Hashida; Isamu Kawai; Kiwamu Nijuri; Hiromi Arakawa, all of Tochigi; Michinori Anahara, Ashikaga, all of Japan

[73] Assignee: Hitachi, Ltd., Tokyo, Japan

[21] Appl. No.: 129,354

[22] Filed: Sep. 30, 1993

[30] Foreign Application Priority Data

Nov. 26, 1992 [JP] Japan ..... 4-316873

[51] Int. Cl.[6] ..... H05B 6/44

[52] U.S. Cl. ..... 373/144; 373/139; 373/145

[58] Field of Search ..... 373/142, 151, 373/146, 139, 138, 148, 145, 157, 144; 219/610; 164/471

[56] References Cited

U.S. PATENT DOCUMENTS

| | | | |
|---|---|---|---|
| 1,378,189 | 5/1921 | Northrup | 373/157 |
| 2,266,002 | 12/1941 | Clark | 373/144 |
| 3,752,216 | 8/1973 | Fritsche | 164/471 |
| 3,948,643 | 4/1976 | Fredriksson et al. | 373/144 |
| 4,996,402 | 2/1991 | Hashida et al. | 373/148 |

FOREIGN PATENT DOCUMENTS 3223486 9/1988 Japan .

*Primary Examiner*—Tu Hoang

*Attorney, Agent, or Firm*—Antonelli, Terry, Stout & Kraus

[57] ABSTRACT

A metal material such as scraps of metal is directly heated by electromagnetic induction, and the resulting molten metal is fed to a heatup zone where the molten metal is further heated to a required temperature. More specifically, the metal material to be melted, which has been charged into a heat and melt zone, is preheated and melted by an induction coil, and the molten metal is passed via a connection portion to the heatup zone, and is stored there. The thus accumulated molten metal is further heated by an induction coil to a necessary temperature. The molten metal is taken out of the furnace by opening a tap hole when this is desired. Various kinds of gases can be selectively introduced into the apparatus via an gas inlet. By keeping the tap hole in an open condition, the molten metal can be continuously taken out of the furnace. With the induction heating method which has heretofore enabled only an intermittent melting operation, the metal material can be continuously melted and taken out. Furthermore, the atmosphere in which the melting operation is effected can be freely controlled, and therefore the melting operation can be carried out highly efficiently. Moreover, zinc in a zinc-coated steel sheet can be separated and recovered by placing cooling plates in the heat and melt zone.

15 Claims, 5 Drawing Sheets

METHOD OF HEATING AND MELTING METAL AND APPARATUS FOR MELTING METAL

This invention relates to a method of heating and melting metal and an apparatus for melting metal, by which metal such as steel and aluminum is continuously heated and melted, and then impurities are separated from the molten metal for refining purposes to provide a metal material re-usable as a resource.

Generally, in the type of metal-melting furnace utilizing electric power, it is difficult to continuously melt metal, for example, in contrast to a cupola, and therefore there has been used an intermittent melting method in which metal to be melted is charged into the furnace, and is melted and raised in temperature, and then the molten metal is discharged from the furnace. Therefore, when supplying molten metal to a continuous casting apparatus, it has been necessary to operate a plurality of melting furnaces.

Recently, there have been developed furnaces utilizing electric power, which are capable of continuously melting metal as in a cupola, and a high-efficiency continuous melting apparatus, designed to melt cast iron by electromagnetic induction heating, has now been put into practice. An electromagnetic induction heating melting apparatus of this type is disclosed, for example, in Japanese Patent Unexamined Publication Nos. 63- 223486 and U.S. Pat. No. 4,996,402.

However, since the above conventional electromagnetic induction heating melting apparatuses are designed mainly to melt cast iron, a carbonaceous exothermic material such as coke is used for heating the molten metal, and the carbon is absorbed by the molten metal. Therefore, these conventional apparatuses have not been suited for the melting of low-carbon iron, such as steel, to which the present invention is directed.

In the case of melting zinc-plated steel sheets (hereinafter referred to as "zinc-coated steel sheet"), produced in a large amount as various kinds of industrial wastes, in an electromagnetic induction furnace, zinc penetrates into a refractory material to shorten the lifetime of the refractory material. And besides, the recovery of zinc is difficult, and although the zinc is arrested in the form of an oxide by a dust catcher, part of it is present as an impurity in the molten metal, which results in a problem that the molten iron of a high purity can hardly be obtained. Therefore, in the case where zinc-coated steel sheets are used to obtain molten cast iron, there are occasions when a cupola causing a considerable environmental pollution is used instead of an electric furnace. With this method, however, the recovery of zinc is difficult, and a satisfactory solution has not yet been achieved.

Thus, the conventional melting furnaces utilizing electric power are basically of the type which discharges the molten metal intermittently. With respect to the above continuous melting apparatus, carbon is used as an exothermic material in the melting of other metal than cast iron and copper, such as steel and aluminum, and therefore an excessive amount of carbon is contained in the metal, and besides the carbon produces carbides. Therefore, such a continuous melting apparatus has not been suited for melting these metals. With respect to steel, attention has been drawn to the removal of zinc from zinc-coated steel sheets recently used in a larger amount.

SUMMARY OF THE INVENTION

With the above problems of the prior art in view, it is an object of this invention to provide a method of heating and melting metal which method can continuously provide molten metal, and can efficiently process zinc-coated steel sheets or the like for recovering purposes.

Another object is to provide a melting apparatus for performing such a method.

The above first object of the invention has been achieved by a method of heating and melting metal comprising the steps of:

providing an apparatus for melting metal by electromagnetic induction heating which apparatus comprises a heat and melt zone and a heatup zone spaced from and operatively connected to the heat and melt zone;

preheating and melting a solid metal material, filled in the heat and melt zone, by electromagnetic induction heating to provide molten metal;

continuously discharging the molten metal from a lower portion of a furnace of the heat and melt zone;

receiving the discharged molten metal in the heatup zone, and further heating the molten metal by electromagnetic induction heating to raise the temperature of the molten metal; and discharging the molten metal, raised in temperature, from a tap hole.

With this method, by continuously charging the solid metal material into the furnace, the metal material is melted effectively, and is continuously discharged from the tap hole. In order to recover, by vapor deposition, the vapor of low-boiling point metal (e.g. zinc) produced during the heating of the metal material, the scavenging means, utilizing a temperature difference provided, for example, by cooling plates, can be removably inserted into the furnace, so that the low-boiling point metal is separated and recovered as a valuable substance. Atmosphere gas, which can be easily combined with impurities in the solid metal material, and can be separated and removed from the molten metal, can be fed into the heat and melt zone through the heatup zone, thereby removing the impurities at one or both of the heat and melt zone and the heatup zone. By doing so, the purity of the molten metal can be enhanced. For example, by controlling the atmosphere to an oxidizing nature, the impurities susceptible to oxidation can be oxidized, and be removed as a slag.

The second object of the invention has been achieved by apparatus for melting metal comprising:

a heat and melt zone for preheating and melting a solid metal material, filled in a furnace, by first electromagnetic induction heating means to provide molten metal;

means for continuously discharging the molten metal from a lower portion of the furnace;

a heatup zone for receiving the discharged molten metal, and for further heating the molten metal to a higher temperature by second electromagnetic induction heating means; and means for discharging the molten metal, heated to the higher temperature, from a tap hole in the heatup zone.

Preferred examples when putting the present invention into practice will now be explained.

(1) The heat and melt zone melts the metal material, filled therein, by electromagnetic induction heating, and therefore a charging port is provided at the top of this portion, and a discharge port (the connection portion between the heat and melt zone and the heatup zone) for discharging the molten metal is provided at the lower part of the heat and melt zone. An induction coil is mounted around the outer circumference of the apparatus.

(2) The just-melted metal of a poor fluidity flows through the above discharge port, and in the case of an oxidizing atmosphere, a large amount of slag flows through this discharge port. Therefore, the discharge port has a relatively large flow area through which gas flows from the heatup zone to the heat and melt zone. In some cases, a grate-like member is provided between the heat and melt zone and the heatup zone.

(3) In the case where the vapor of low-boiling point metal (zinc) is produced as a result of heating the metal material (e.g. zinc-coated steel sheet), scavenging means for catching such metal vapor is provided. More specifically, for example, a plurality of cooling plates are removably inserted into that region of the heat and melt zone 1 having such temperatures as to cause the low-boiling point metal to evaporate, and are radially arranged in such directions as not to interrupt the magnetic flux, generated by the induction coil, as much as possible. With this arrangement, zinc is vapor-deposited on the cooling plates, and the cooling plates are withdrawn from the heat and melt zone when appropriate, and the zinc is separated and recovered. Another example of scavenging means comprises a metal vapor scavenging chamber which is provided within the heat and melt zone, and includes a metal vapor scavenging port, a low-temperature portion for catching the metal vapor, and a suction port for creating a negative pressure within the scavenging chamber. The suction port is connected to a suction means such as a vacuum pump provided outside of the furnace.

(4) The heatup zone further heats the molten metal, flown thereinto from the heat and melt zone, to a necessary temperature. Therefore, the heating and temperature-raising portion is a crucible-like device having an appropriate volume, and is connected at its upper portion to the heat and melt zone, and has the tap hole for discharging the overflowing molten metal. An induction coil is mounted around the outer circumference of the heatup zone.

(5) When it is desired to remove impurities by oxidation, the heat and melt zone even including its metal-melting part is brought into an oxidizing atmosphere, using the air or the like, and the impurities are shifted into a slag. Thereafter, the heatup zone is brought into a reducing atmosphere of CO, $H_2$ or the like. Namely, there is provided an atmosphere gas supply device for feeding atmosphere gas either directly into the heat and melt zone or into the heat and melt zone via the heatup zone, and a suitable oxidizing/reducing gas is selected in accordance with the kind of impurities to be removed from the metal material to be melted, and is fed from this atmosphere gas supply device.

(6) The molten metal is discharged from the tap hole of the heatup zone in an amount corresponding to the amount of the molten metal supplied thereto from the heat and melt zone. However, the apparatus may be of an intermittently-discharging type in which the tap hole is closed temporarily to store the molten metal in the heatup zone, and is opened, when necessary, to discharge a necessary amount of the molten metal.

(7) The heatup zone is disposed below the heat and melt zone. These two portions may be arranged either in such a manner that the furnaces of the two portions are coaxial with each other, or in such a manner that the axes of the furnaces of the two portions are offset from each other to effectively reduce the interference between the electromagnetic induction on the heat and melt zone and the electromagnetic induction on the heatup zone. The two portions are interconnected by a connection portion which allows the molten metal and gas to flow therethrough.

(8) The tap hole is provided at the lower part of the heatup zone or the side wall thereof. The tap hole may be of the overflow type which causes the molten metal to overflow the furnace when the molten metal is stored in a predetermined amount. By providing a ladle beneath this tap hole, the molten metal can be always received easily. There may be provided a device for intermittently discharging the molten metal which device can selectively force gas or a refractory block into the heatup zone to discharge a necessary amount of the molten metal from the tap hole. An openable window may be provided on the top of the heatup zone spaced from the connection portion so that the observation of the interior of the furnace, as well as the maintenance and inspection, can be effected through this window.

(9) First and second temperature measuring means can be provided respectively in the heat and melt zone and the heatup zone, and also there can be provided temperature control means responsive to output signals from the first and second temperature measuring means for keeping the temperature within the heatup zone higher than the temperature within the heat and melt zone. Thus, the temperature within the heatup zone can be controlled automatically. Usually, the heat and melt zone is set to a temperature near the melting point of the metal material to be melted, and the heatup zone is set to a temperature sufficiently higher than this melting point. For example, in the case of using a steel material as the metal to be melted, the temperature of the heat and melt zone is set to about 1540° C., and the temperature of the heatup zone is set to about 1700° C.

In the above construction, almost all metals (including alloys) including steel, aluminum, copper and cast iron, can be continuously melted effectively.

As explained above, in the metal heating and melting method and the metal melting apparatus according to the present invention, the metal material filled in the heat and melt zone is heated by induction power from the first induction heating coil, and is finally melted. This molten metal enters the heatup zone where the molten metal is further heated to a necessary temperature by induction power from the second induction heating coil. Thus, there is obtained the molten metal having a temperature necessary for casting at a later stage. Carbon (e.g. coke), used as an exothermic medium in the conventional electromagnetic induction heating, is not used in the present invention, and the metal material to be melted itself constitutes an exothermic medium, and therefore carbon does not increase in the molten metal. Furthermore, in order to remove impurities from the metal material, the atmosphere in the furnace can be an atmosphere of gas which can easily react with the impurities, and the impurities can be removed or decreased in the form of a slag, or in a gasified form. The gas atmosphere may be an oxidizing atmosphere, a reducing atmosphere, or a neutral atmosphere (inert gas).

DESCRIPTION OF THE PREFERRED EMBODIMENTS

A preferred embodiment of the present invention will now be described with reference to the drawings.

Embodiment 1

Figure 1:
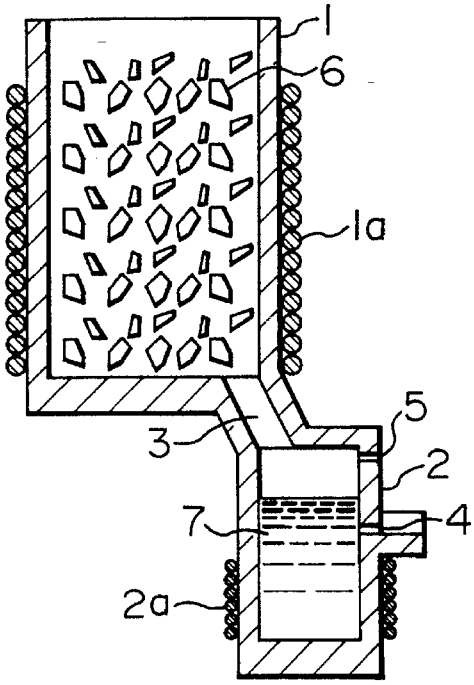
FIG. 1 is a vertical cross-sectional view of an important portion of a preferred embodiment of a continuous metal-melting apparatus of the present invention.

FIG. 1 is a cross-sectional view of an important portion of an apparatus for explaining a method of and apparatus for heating and melting metal in accordance with the present invention. An induction coil 1*a*, constituting a first electromagnetic induction heating means, is wound on an outer periphery of a heat and melt zone 1. A heatup zone 2 receives molten metal, and heats it. An induction coil 2*a*, constituting a second electromagnetic induction heating means, is wound on an outer periphery of the heatup zone 2. A connection portion 3 interconnects the heat and melt zone 1 and the heatup zone 2, and passes the molten metal from the heat and melt zone 1 to the heatup zone 2, and also passes gas from the heatup zone 2 to the heat and melt zone 1. Reference numeral. 4 denotes a tap hole, reference numeral 5 an gas inlet, reference numeral 6 a material to be melted, and reference numeral 7 molten metal.

The construction and operation of this apparatus will now be described. When electric power is supplied from an AC power source (not shown) to the induction coil 1*a* around the heat and melt zone 1, the material 6 to be melted is heated through electromagnetic induction heating, and is melted, and passes through the connection portion 3, and is stored, as molten metal 7, in the heatup zone 2. The molten metal 7 is further heated to a required temperature by the induction coil 2*a*. The molten metal 7, supplied from the heat and melt zone 1, is thus heated and increased in amount, and is continuously discharged from the tap hole 4. The tap hole 4 can be closed temporarily to store the molten metal 7 in the apparatus, and opened to discharge the molten metal when necessary.

In this apparatus, the heat and melt zone 1 and the heatup zone 2 are offset from each other, so that the two coils 1*a* and 2*a* are not disposed coaxially with each other. With this arrangement, electromagnetic inductions by the two coils 1*a* and 2*a* will not interfere with each other, thereby achieving a highly-efficient electromagnetic induction heating.

Embodiment 2

Figure 2:
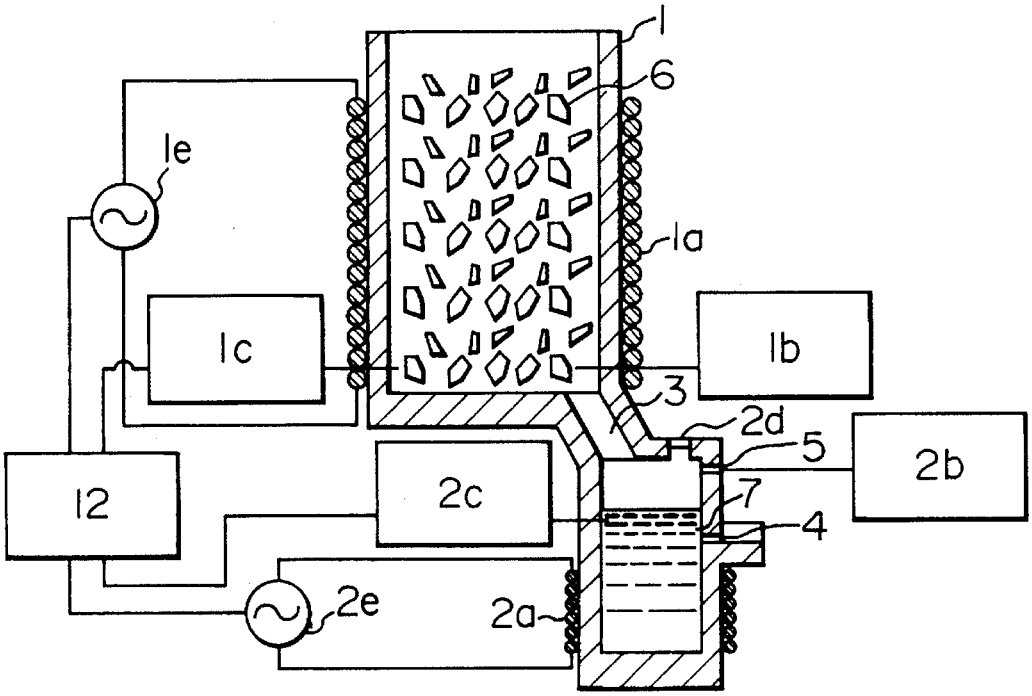
FIG. 2 is a vertical cross-sectional view of a modified continuous melting apparatus of the invention.

FIG. 2 is a cross-sectional view of an important portion of an improvement of the prototype of Example 1. In FIG. 2, reference numerals 1*b* and 2*b* denote atmosphere control means for supplying atmosphere gas into a furnace, reference numeral 2*d* a window which can be opened and closed, reference numerals 1*c* and 2*c* temperature measuring means, reference numerals 1*e* and 2*e* power sources for electromagnetic induction heating, and reference numeral 12 a temperature control means.

The atmosphere control means 1*b* is associated with a heat and melt zone 1 in accordance with the kind of a material 6 to be melted. The atmosphere control means 1*b* supplies, for example, oxidizing gas to oxidize impurities in the material 6 to be melted to form a slag which is separated and removed from the molten metal.

The atmosphere control means 2*b* comprises an atmosphere gas feeding device which is associated with a heatup zone 2, and feeds atmosphere gas into the heat and melt zone 1 through the heatup zone 2. Examples of gas fed from this atmosphere gas feeding device 2*b* include oxidizing gas such as the air, reducing gas such as CO and $H_2$, and neutral gas (inert gas) such as $N_2$.

Depending on the kind of the material 6 to be melted, the atmosphere control means 1*b* can feed oxidizing gas to effect an oxidation treatment in the heat and melt zone 1 whereas the atmosphere control means 2*b* feeds reducing gas to effect a reduction treatment in the heatup zone 2.

The temperature measuring means 1*c* measures the temperature within the heat and melt zone 1, and the temperature measuring means 2*c* measures the temperature within the heatup zone 2. The temperature control means 12 is responsive to output signals from these temperature measuring means 1*c* and 2*c* to control the power sources 1*e* and 2*e* for the electromagnetic induction heating in such a manner as to keep the temperature within the heatup zone 2 higher than the temperature within the heat and melt zone 1.

The window 2*d* which can be opened and closed is provided at the top of the heatup zone 2 spaced from the connection portion 3. The observation of the interior of the furnace, as well as the maintenance and inspection of the furnace, can be made through the window 2*d*.

Embodiment 3

In a conventional induction melting apparatus, in an initial stage of the melting steps a material is melted by the heating of the material, in and after a middle stage thereof a molten metal stored in a crucible being heated, and other solid material remaining in the crucible is heated and melted by the heat of the heated molten metal. Thus, in the induction melting apparatus of the prior art it was impossible to consecutively charge the crucible with the material and to consecutively discharge the molten metal from the crucible.

An induction melting apparatus embodying the present invention makes it possible to consecutively melt a material without using coke while in the apparatus of U.S. Pat. No. 4,996,402 a consecutive melting was effected by use of coke. If an experimental apparatus forming a heat and melt zone of the induction melting apparatus embodying the present invention makes it possible to consecutively discharge a molten metal therefrom by heating a solid material consecutively fed in the experimental apparatus, this will prove the practicality of the induction melting apparatus of the present invention because the heating of the molten metal for raising the temperature thereof up to a predetermined necessary temperature can be carried out by use of a conventional technique.

Figure 9:
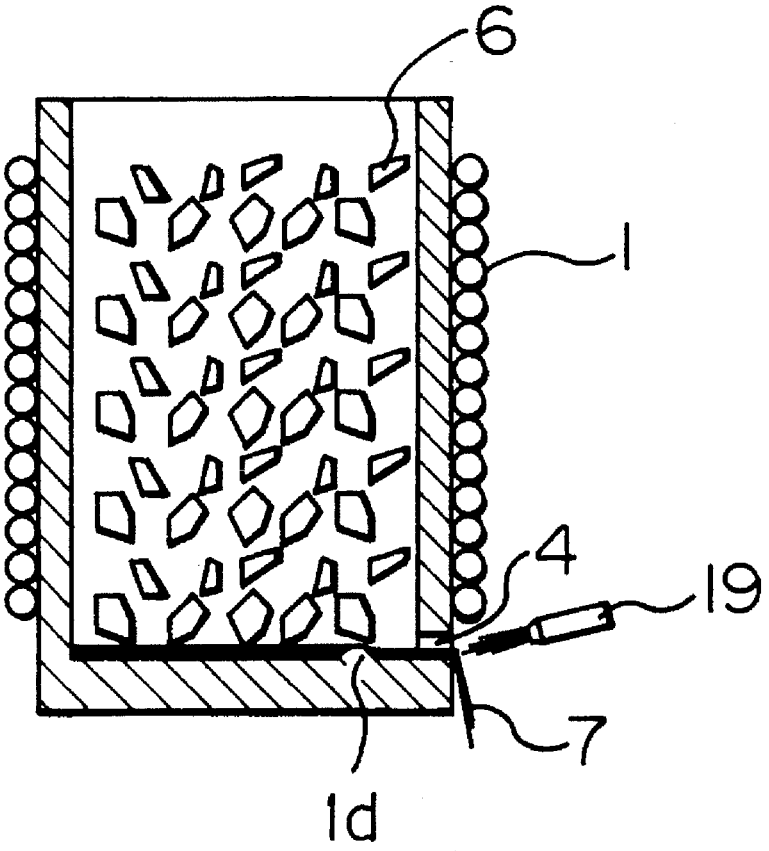
FIG. 9 is a cross-sectional view of a heating and melting portion constituting a metal-melting apparatus of the invention.

Thus, by use of an apparatus shown in FIG. 9 which apparatus corresponds to a heat and melt zone (1) of the electromagnetic induction heating apparatus of the present invention, there was conducted the consecutive melting of each of cast iron, copper, steel and zinc-coated steel sheet. In this consecutive melting, the molten metal was discharged at a temperature slightly above a melting point of each metal (, which discharge differs from that of Japanese Patent Unexamined Publication No. 2-225630 et. in which a molten metal to be discharged is controlled to have a predetermined necessary temperature, not a temperature just above the melting point) by use of a dam (1*d*) provided on the bottom of the furnace while heating a melt-discharging port by a flame of oxygen-acetylene so as to keep the temperature of the melt-discharging port at a suitable point for preventing the discharging melt from being resolidified in the vicinity of the melt-discharging port. Of course, in a commercial apparatus shown in FIG. 1 a molten metal can be discharged consecutively from the heat and melt zone (1) without conducting this temperature-keeping operation because the melt-discharging port provided in the heat and melt zone (1) of the commercial apparatus is heated by the heatup zone (2) of the electromagnetic induction apparatus of the present invention and because a large amount of molten metal is discharged through the port. In Table 1 there are shown melting operations in about 30 minutes which were obtained by use of the apparatus shown in FIG. 9 at a frequecy of 9.6 kHz while keeping a constant output of 35 kW and while consecutively feeding a material so as to compensate the melted and dicharged material.

TABLE 1

| Materials | Temp. of melt discharged | Rate of melting | State of melting |
|---|---|---|---|
| Cast iron scrap | about 1300° C. | about 70 Kg/h | Occurrence of fluidized slag |
| Copper wire | about 1200° C. | about 120 Kg/h | Occurrence of fluidized slag |
| Steel sheet | about 1600° C. | about 50 Kg/h | Occurrence of fluidized slag |
| Zinc-coated steel sheet | about 1600° C. | about 40 Kg/h | Occurrence of much amount of white smoke |
| Aluminum sheet | about 700° C. | about 70 Kg/h | Oxide remained after the completion of melting |

After the melting operations shown in Table 1, there was obtained an ingot of each of the melted metals. Thus, it was possible to consecutively melt the materials by use of the technique of the present invention, and the practicality of the present invention was proved.

Further, since the temperature of the molten metals was relatively low in the experiments, the molten metals were cast into ingots. However, it is of course possible to directly cast the molten metals into products by controlling the temperature of the molten metals in the heatup zone provided under the heat and melt zone. Incidentally, in the case of melting of ferrous metals, it is possible to remove impurities readily oxidized such as P etc. mixed in the material because the readily oxidized impurities change into oxides which are then shifted into slag, with the result that the purity of the metals can be enhanced. On the other hand, carbon content in the melted cast iron material etc. is reduced due to the oxidation thereof. In order to prevent the reduction in the carbon content, a suitable amount of carbon such as coke may be added, which added carbon increases the carbon content in the melt by the direct penetration thereof and contacts with oxides to thereby generate CO gas which makes a reducing atmosphere in the furnace.

The melting of zinc-coated steel sheet was also able to be effected although smoke (vapour of zinc oxide) of white color occurred, however, it is unknown what influence occurs on a refractory constituting the inner wall of the furnace when the melting of the zinc-coated steel sheet is effected in a long period of time. Since the while colour smoke of a small amount also occurred from the molten steel melt, it seems necessary to positively remove zinc in the course of heating the zinc-coated steel sheet.

In the case of melting of aluminum, differing from the cases of iron, copper and etc., since the oxide of aluminum is high in melting point with the result that it is hard to expel it as fluidized slag and since it is hard to readily reduce aluminum oxide, it is desirable to introduce an inert gas such as Ar or nitrogen gas in the furnace so as to prevent the oxidation of aluminum.

Embodiment 4

FIG. 3 shows an example of apparatus capable of easily separating and recovering low-boiling point metal, as a valuable material, from a material 6 to be melted.

Figure 3A:
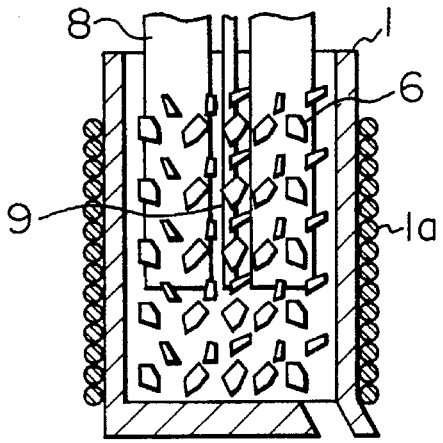
FIGS. 3*a* to 3*c* are vertical cross-sectional view of another modified continuous melting apparatus having a device for separating and recovering low-boiling point metal such as zinc which device is provided in a heat and melt zone.
Figure 3B:
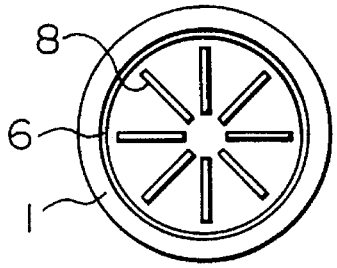
Figure 3C:
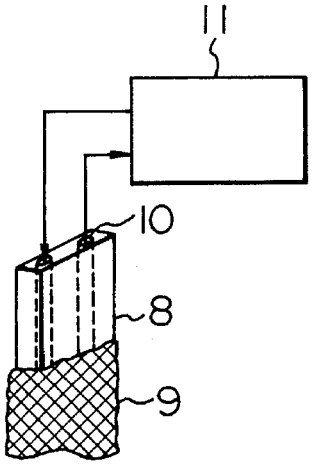

FIG. 3*a* is a cross-sectional view of an important portion of a heat and melt zone 1, with a heatup zone 2 omitted for illustration purposes, and FIG. 3*b* is a plan view of the heat and melt zone 1. FIG. 3*c* schematically shows a cooling plate and a cooling medium circulating device, the cooling plate serving as metal vapor scavenging means inserted in the heat and melt zone 1 for recovering the vapor of low-boiling point metal by vapor-deposition. In these Figures, reference numeral 8 denotes the cooling plate, reference numeral 9 the low-boiling point metal vapor-deposited (and hence recovered) on the cooling plate 8, reference numeral 10 a cooling medium circulating port for circulating a cooling medium, such as water, in the cooling plate 8, and reference numeral 11 the cooling medium circulating device.

As shown in the drawings, a plurality of cooling plates 8 are removably inserted into that region of the heat and melt zone 1 having such temperatures as to cause the low-boiling point metal to evaporate, and are radially arranged in such directions as not to interrupt the magnetic flux, generated by an induction coil 1*a*, as much as possible. This apparatus is advantageous when a material 6 to be melted is one, such as zinc-coated steel sheet, which produces the vapor of low-boiling point metal (zinc) upon heating.

The construction and operation of this apparatus will now be described in further detail. When electric power is supplied from an AC power source (not shown) to the induction coil 1*a* for effecting the preheating and melting operation, the material 6 to be melted, such as a zinc-coated steel sheet, is heated by electromagnetic induction heating. Then, when the temperature rises above the boiling point of this low-boiling point metal (e.g. zinc), the low-boiling point metal evaporates into metal vapor. If there exists an object having a temperature lower than this boiling point, this vapor again vapor-deposits on the surface of this object. Therefore, when the cooling plates 8 are placed in that region where the metal vapor is present, the low-boiling point metal vapor-deposits on the surfaces of the cooling plates 8. When the amount of the vapor-deposited metal 9 reaches a predetermined level, the cooling plates 8 are withdrawn from the furnace, and the vapor-deposited metal 9 is removed or peeled from the cooling plate 8, thereby recovering the low-boiling point metal such as zinc.

Namely, within the heat and melt zone 1, the metal (zinc) vapor-deposits on the cooling plates 8 serving as the scavenging means, and then the cooling plates 8 are withdrawn from the furnace, and the vapor-deposited metal (zinc) is separated from the cooling plate 8 as by shaving, so that the low-boiling point metal can be easily recovered. The cooling medium circulating means 11 may comprise a pump mechanism for circulating water (cooling medium) in the cooling plate 8.

Embodiment 5

Figure 4:
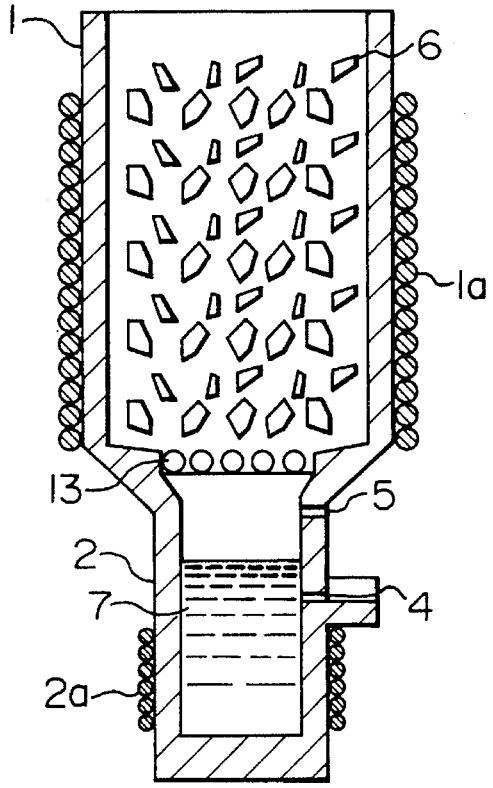
FIG. 4 is a vertical cross-sectional view of an important portion of a further modified continuous melting apparatus of the invention.

FIG. 4 is a cross-sectional view of a melting apparatus in which a heat and melt zone 1 and a heatup zone 2 are connected together substantially coaxially with each other. A grate 13 is provided at a portion of connection between the heat and melt zone 1 and the heatup zone 2. The metal melted in the heat and melt zone 1 flows from the heat and melt zone 1 through the grate 13 into the heatup zone 2 disposed beneath the heat and melt zone 1. The molten metal 7 is further heated and raised in temperature, and is recovered from a tap hole 4. In this apparatus, since the heat and melt zone 1 and the heatup zone 2 are connected together in substantially coaxial relation to each other, there is a problem of magnetic interference between induction coils 1*a* and 2*a*, and this apparatus is inferior in heating efficiency to the apparatuses of Examples 1 and 2, but has an advantage that the furnace is simple in construction, and can be of a relatively compact size.

Embodiment 6

Figure 5:
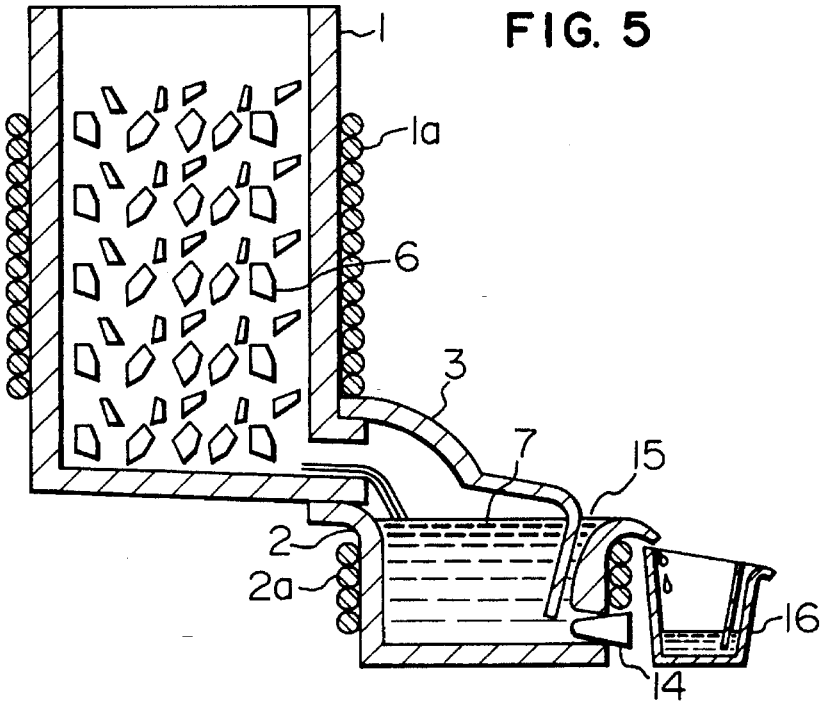
FIG. 5 is a vertical cross-sectional view of an important portion of a further modified continuous melting apparatus of the invention.

FIG. 5 is a cross-sectional view of a melting apparatus having a modified form of heatup zone 2. In FIG. 5, reference numeral 14 denotes a molten metal plug serving also as a maintenance-inspection window, reference numeral 15 a tap hole of the overflow type through which the molten metal overflows the furnace of the heatup zone 2 when the molten metal within the heatup zone 2 is stored in a predetermined amount, and reference numeral 16 a ladle for receiving the molten metal.

Although a method of discharging the molten metal is not shown in this Example and the other Examples, a necessary amount of the molten metal may be discharged, when necessary, for example, by applying pressurized gas into the heatup zone 2, or by forcing a refractory block into the molten metal stored in the heatup zone 2.

Embodiment 7

Figure 6:
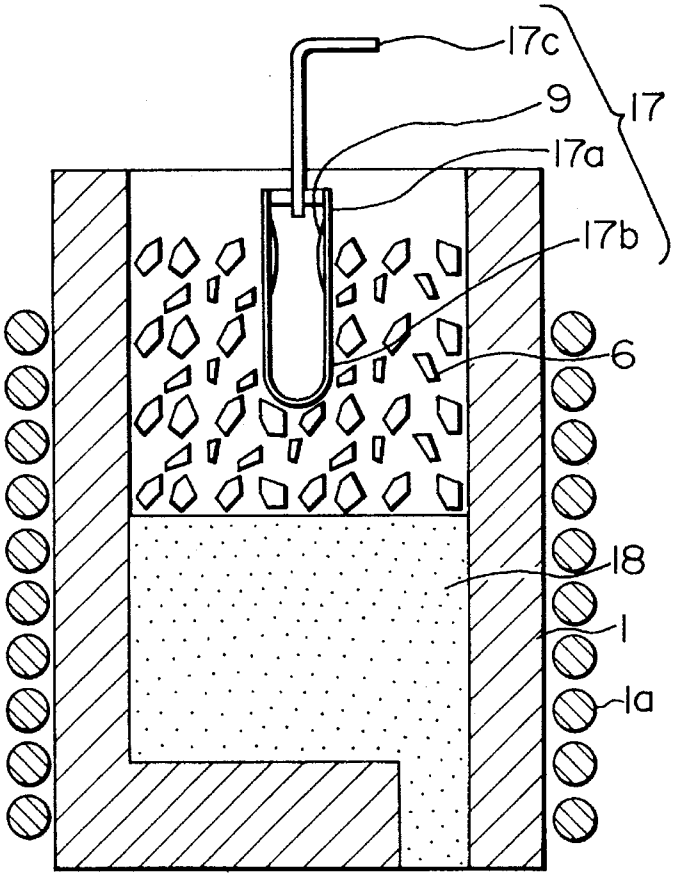
FIG. 6 is a vertical cross-sectional view of an important portion of a heating and melting portion having a modified device for separating and recovering low-boiling point metal such as zinc.

FIG. 6 is a cross-sectional view of a melting apparatus having a modified form of heat and melt zone. In FIG. 6, reference numeral 1 denotes a heat and melt zone made of a refractory material, reference numeral 1*a* an induction coil wound on the outer periphery of the heat and melt zone 1, reference numeral 6 a solid metal material to be melted, reference numeral 17 denotes a metal vapor scavenging chamber for recovering the vapor of low-boiling point metal, reference numeral 17*a* a shell defining the scavenging chamber 17, reference numeral 17*b* a vapor scavenging port for drawing the metal vapor into the scavenging chamber therethrough, reference numeral 17*c* an exhaust pipe connected to a vacuum pump (not shown) to create a negative pressure in the scavenging chamber, reference numeral 9 vapor-deposited metal caught on a low-temperature portion within the scavenging chamber, and reference numeral 18 sand (which is not used in an actual melting furnace) filled in a bottom portion of the furnace.

The metal vapor scavenging chamber 17 is arranged in such a manner that the vapor scavenging ports 17*b*, provided in the periphery of one end portion of this chamber 17, are disposed in a high-temperature portion within the furnace whereas the other end portion of the chamber 17 is disposed in the low-temperature portion where the metal vapor can be recovered. The vapor of the low-boiling point metal within the furnace is drawn into the scavenging chamber 17 through the vapor scavenging ports 17*b*, and is vapor-deposited (and hence recovered) on a wall surface of a low-temperature region within the scavenging chamber 17.

The shell 17*a* of the metal vapor scavenging chamber 17 is made of a refractory material such as alumina and silica.

Next, reference is now made to an example in which zinc was recovered from zinc-coated steel sheets (sample of the solid metal to be melted) in this melting apparatus. This experiment was conducted using a small-scale test apparatus in order to confirm the principle of the zinc-recovering operation. Therefore, the sand 18, which is not actually used when melting a zinc-coated steel plate, is filled in the bottom portion of the furnace.

Using zinc scraps as a sample, zinc could be recovered in the scavenging chamber 17, as described below. In the actual continuous melting operation, the zinc vapor scavenging chamber 17 is disposed in a predetermined position within the furnace, so that the zinc vapor can be kept to a temperature best suited for recovery, and therefore zinc can be recovered efficiently.

In the actual metal melting furnace, the sand 18 is not used, and the zinc scraps are charged into the furnace as far as the bottom of the furnace, and the steel contained in the zinc scraps is melted, and is caused to flow from an outlet into a heatup zone (not shown) where the molten metal is further heated and raised in temperature, and then the molten metal is recovered from a tap hole. Here, however, in order to explain the principle of the zinc recovery as described above, in the test, the sand was filled in the bottom portion of the furnace, and a small amount of zinc scraps were charged into the furnace, and were heated to such a temperature that zinc was completely evaporated.

(1) Construction of heat and melt zone 1

Shape of induction coil: inner diameter: 380 mm; height: 380 mm

Inner diameter of preheating and melting furnace: 280 mm

Frequency: 9600 Hz (2) Construction of metal vapor scavenging chamber 17

A refractory shell 17*a* had a length of 160 mm and an inner diameter of 40 mm, and four holes or ports about 10 mm in diameter were formed in that portion of the shell 17*a* disposed adjacent to its lower end, and an exhaust pipe 17*c* was connected to an upper end of the shell 17*a*.

(3) Material used

Scraps of zinc-coated steel sheet (0.3 mm thick) from pressing (The amount of coating of zinc: 18 g/m$^2$)

(4) Test method and Results

As shown in FIG. 6, sand was filled in a lower half of the heat and melt zone 1, and then about 20 kg of scraps 6 were charged into the heat and melt zone 1 to be disposed above the sand. Using an output of 3~19 KW, the temperature of that region near to the bottom portion of the scavenging chamber 17 was kept to about 900° C., and the temperature of the surface of the scrap layer in the heat and melt zone 1 was kept to 10°~200° C., and the scavenging chamber 17 was evacuated at a rate of 3 liter/minute. This condition was maintained for 10 minutes, and as a result about 5 g of zinc was vapor-deposited (and hence recovered) on an upper portion of the inner wall of the scavenging chamber 17.

Embodiment 8

Figure 7:
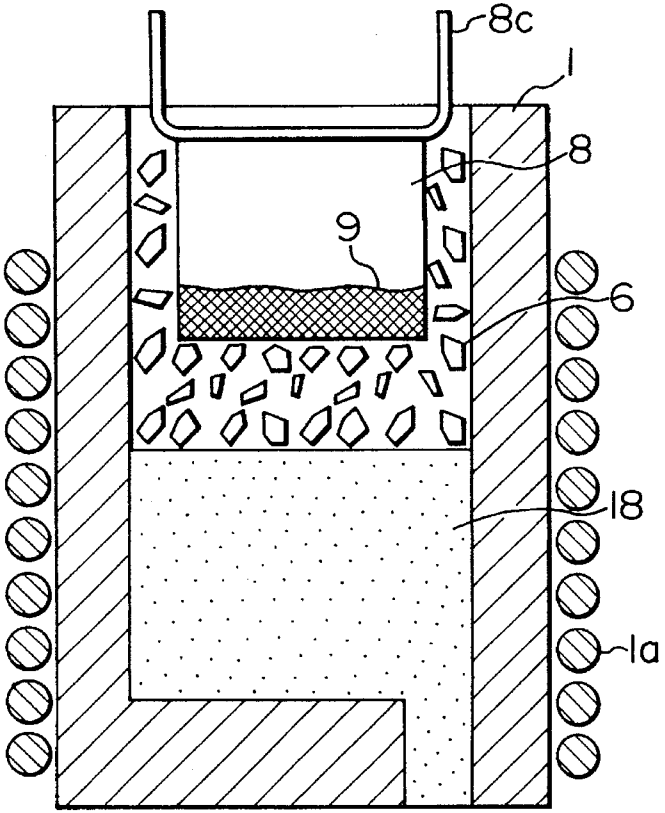
FIG. 7 is a vertical cross-sectional view of an important portion of a heat and melt zone having another modified device for separating and recovering low-boiling point metal such as zinc.

FIG. 7 is cross-sectional view of a heat and melt zone having a modified metal vapor scavenging means. In FIG. 7, reference numeral 6 denotes a solid metal material to,be melted, reference numeral 8 a cooling plate of copper for recovering the vapor of low-boiling point metal, reference numeral 8*c* a water-cooled pipe for cooling the cooling plate 8, reference numeral 9 vapor-deposited metal caught by the cooling plate 8, and reference numeral 18 sand (which is not used in an actual melting furnace) filled in a bottom portion of the furnace.

Figure 8:
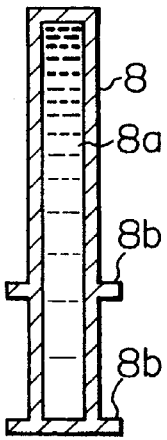
FIG. 8 is a cross-sectional view of one example of cooling plate capable of separating and recovering low-boiling point metal.

Using scraps of zinc-coated steel sheet as a sample, a fundamental test for recovering zinc was conducted in the same manner as described for Example 6, and similar results were obtained. In this case, the cooling plate 8 is made of copper, and when the temperature of the copper exceeds 500° C., the cooling plate 8 is markedly corroded by zinc. Therefore, in practical use, it is necessary to cause cooling water 8*a* to flow directly through the interior of the cooling plate 8 to cool this plate, as shown in FIG. 8. When the cooling plate 8 is withdrawn from the furnace 1, zinc deposited on this plate 8 may be peeled from the plate 8. Therefore, it is effective to form fins 8*b* on the cooling plate 8 so as to prevent the deposited zinc from being peeled from the cooling plate 8.

(1) Construction of heat and melt zone 1

The same as described above for Example 6 of FIG. 6.

(2) Cooling plate 8

The cooling plate 8 had a width of 180 mm, a length of 150 mm and a thickness of 5 mm, and the cooling plate 8 of copper was cooled at one end thereof by water.

(3) Material used

The same as described above for Example 6.

(4) Test method and results

As shown in FIG. 7, sand 18 was filled in a lower half of the heat and melt zone 1, and then about 20 kg of scraps 6 were charged into the heat and melt zone 1 to be disposed above the sand. Using an power of 3–15 KW, the temperature of that region near to the lower end portion of the cooling plate 8 of copper was kept to about 900° C., and the temperature of the surface of the scrap layer in the heat and melt zone 1 was kept to 100°–200° C. This condition was maintained for 10 minutes, and as a result about 2 g of zinc, vapor-deposited on that portion of the cooling plate 8 spaced about 50 mm from the lower end of the cooling plate 8, was recovered.

In the present invention, the objects of the invention have been achieved as described above. Namely, metal, for example, in the form of scraps, was efficiently melted continuously by induction heating, and could be re-used. Furthermore, with respect to zinc-coated steel sheets which have heretofore been difficult to be re-used, steel of good quality can be advantageously regenerated while recovering zinc by separation.

What is claimed is:

1. A method of heating and melting metal comprising the steps of:

providing an apparatus for melting metal by electromagnetic induction heating which apparatus comprises a heat and melt zone and a heatup zone spaced from and operatively connected to said heat and melt zone;

preheating and melting a solid metal material, filled in said heat and melt zone, by electromagnetic induction heating to provide molten metal in said heat and melt zone;

continuously discharging said molten metal from a lower part of said heat and melt zone;

receiving said discharge molten metal in said heatup zone, and further heating said molten metal by electromagnetic induction heating to raise the temperature of said molten metal;

discharging said molten metal, raised in temperature, from a tap hole; and in which scavenging means for recovering, by vapor deposition, a vapor of low-boiling point metal, produced as a result of said preheating and melting of said solid metal material, utilizing a temperature difference, is inserted into said heat and melt zone to separate and recover said low-boiling point metal.

2. A method of heating and melting metal comprising the steps of:

providing an apparatus for melting metal by electromagnetic induction heating which apparatus comprises a heat and melt zone and a heatup zone spaced from and operatively connected to said heat and melt zone;

preheating and melting a solid metal material, filled in said heat and melt zone, by electromagnetic induction heating to provide molten metal in said heat and melt zone;

continuously discharging said molten metal from a lower part of said heat and melt zone;

receiving said discharge molten metal in said heatup zone, and further heating said molten metal by electromagnetic induction heating to raise the temperature of said molten metal;

discharging said molten metal, raised in temperature, from a tap hole, and said method further comprising the step of feeding atmosphere gas, which is easily combined with impurities in said solid metal material, and is separated and removed from said molten metal, into said heat and melt zone through said heatup zone, thereby removing the impurities in one or both of said heat and melt zone and said heatup zone.

3. A method of heating and melting metal comprising the steps of:

providing an apparatus for melting metal by electromagnetic induction heating which apparatus comprises a heat and melt zone and a heatup zone spaced from and operatively connected to said heat and melt zone;

preheating and melting a solid metal material, filled in said heat and melt zone, by electromagnetic induction heating to provide molten metal in said heat and melt zone;

continuously discharging said molten metal from a lower part of said heat and melt zone;

receiving said discharge molten metal in said heatup zone, and further heating said molten metal by electromagnetic induction heating to raise the temperature of said molten metal;

discharging said molten metal, raised in temperature, from a tap hole; and in which said step of preheating and melting said solid metal material comprises the steps of supplying oxidizing gas into said heat and melt zone, and melting said solid metal material in an oxidizing atmosphere, and said step of further heating said molten metal in said heatup zone comprises the steps of supplying reducing gas into said heatup zone, and heating said molten metal in a reducing atmosphere to raise the temperature of the molten metal.

4. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which scavenging means for recovering, by vapor deposition, a vapor of low-boiling point metal, produced as a result of preheating and melting a solid metal material in said heat and melt zone of said furnace, in accordance with a temperature difference, is provided within said furnace having said heat and melt zone to separate and recover said low-boiling point metal from the furnace.

5. Apparatus according to claim 4, in which said scavenging means comprises a metal vapor scavenging chamber which includes a metal vapor scavenging port, a low-temperature portion for catching the metal vapor, and a suction port for creating a negative pressure within said chamber.

6. Apparatus according to claim 4, in which said scavenging means comprises a plurality of radially-arranged cooling plates removably inserted into the furnace from a top of said heat and melt zone.

7. Apparatus according to claim 6, in which fins are formed on an outer periphery of said cooling plates, and are projected therefrom in a direction perpendicular to the direction of withdrawal of said cooling plates from the furnace, thereby preventing the metal, vapor-deposited on the outer periphery of the cooling plate, from being peeled from said outer periphery.

8. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which said heatup zone is disposed below said heat and melt zone, and axes of the furnaces of said heat and melt zone and the heatup zone are offset from each other by a distance such that interference between the electromagnetic induction on said heat and melt zone and the electromagnetic induction on said heatup zone is effectively reduced.

9. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which there is provided a device for intermittently discharging the molten metal which device temporarily closes the tap hold of said heatup zone to store the molten metal in said heatup zone, and selectively opens said tap hole to discharge a necessary amount of the molten metal.

10. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which said heat and melt zone and said heatup zone are interconnected by a connection portion which allows the molten metal and gas to pass therethrough.

11. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which said heat and melt zone and said heatup zone are generally aligned with each other in a vertical direction, and a grate is provided between said heat and melt zone and said heatup zone.

12. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which said heatup zone tap hole is an overflow type tap hole through which the molten metal overflows when the molten metal is stored in a predetermined amount within said additional furnace.

13. Apparatus for melting metal comprising:

a furnace having a heat and melt zone in which a solid metal material filled ill said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which there is provided a device for intermittently discharging the molten metal which device selectively forces gas or a refractory block into the molten metal stored in said heatup zone to discharge a necessary amount of the molten metal from the tap hole.

14. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and in which there is provided an atmosphere gas supply device for feeding atmosphere gas either directly into said heat and melt zone or into said heat and melt zone via said heatup zone.

15. Apparatus for melting metal comprising:

a furnace having a heat and melt zone in which a solid metal material filled in said furnace can be held for preheating and melting said solid metal material by first electromagnetic induction heating means to provide molten metal in said heat and melt zone of said furnace;

means for continuously discharging said molten metal from a lower portion of the heat and melt zone of said furnace;

an additional furnace having a heatup zone for receiving said discharged molten metal, and for further heating said molten metal to a higher temperature by second electromagnetic induction heating means;

means for discharging said molten metal, heated to the higher temperature, from a tap hole in said heatup zone of said additional furnace; and further comprising first and second temperature measuring means provided respectively in said heat and melt zone and said heatup zone, and temperature control means responsive to output signals from said first and second temperature measuring means for keeping the temperature within said heatup zone higher than the temperature within said heat and melt zone.

* * * * *

UNITED STATES PATENT AND TRADEMARK OFFICE

CERTIFICATE OF CORRECTION

PATENT NO. : 5,479,436

DATED : December 26, 1995

INVENTOR(S) : Hideo HASHIDA ET AL.

It is certified that error appears in the above-identified patent and that said Letters Patent is hereby corrected as shown below:

on the title page, Item [75],

Under the list of inventors, please add the following inventor:

-- Hideki Kanno of Tochigi --.

Signed and Sealed this

Eleventh Day of May, 1999

*Attest:*

*Attesting Officer*

Q. TODD DICKINSON

*Acting Commissioner of Patents and Trademarks*